US008821998B2

(12) United States Patent
Romano

(10) Patent No.: US 8,821,998 B2
(45) Date of Patent: Sep. 2, 2014

(54) RECORDING MEDIUM FOR INKJET PRINTING

(71) Applicant: Charles E. Romano, Wisconsin Rapids, WI (US)

(72) Inventor: Charles E. Romano, Wisconsin Rapids, WI (US)

(73) Assignee: Newpage Corporation, Miamisburg, OH (US)

( * ) Notice: Subject to any disclaimer, the term of this patent is extended or adjusted under 35 U.S.C. 154(b) by 0 days.

(21) Appl. No.: 14/036,849

(22) Filed: Sep. 25, 2013

(65) Prior Publication Data

US 2014/0030451 A1 Jan. 30, 2014

Related U.S. Application Data

(63) Continuation-in-part of application No. 13/859,239, filed on Apr. 9, 2013.

(60) Provisional application No. 61/682,416, filed on Aug. 13, 2012, provisional application No. 61/623,931, filed on Apr. 13, 2012.

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/508* (2013.01); *B41M 5/5236* (2013.01); *B41M 5/5227* (2013.01); *B41M 5/5245* (2013.01); *B41M 5/52* (2013.01); *B41M 5/5254* (2013.01)

USPC ..... 428/32.21; 428/32.28; 428/32.3; 428/32.35; 428/32.38

(58) Field of Classification Search

CPC .. B41M 5/508; B41M 5/5218; B41M 5/5227; B41M 5/5236; B41M 5/5245; B41M 5/5254

USPC ..... 428/32.21, 32.28, 32.3, 32.35, 32.38

See application file for complete search history.

(56) References Cited

U.S. PATENT DOCUMENTS

| | | | |
|---|---|---|---|
| 1,941,001 | A | 12/1933 | Hansell |
| 3,197,322 | A | 7/1965 | Maskal et al. |
| 3,373,437 | A | 3/1968 | Sweet et al. |
| 3,416,153 | A | 12/1968 | Hertz et al. |
| 3,798,047 | A | 3/1974 | Delfosse |
| 3,878,519 | A | 4/1975 | Eaton |
| 4,346,387 | A | 8/1982 | Hertz |
| 4,714,603 | A | 12/1987 | Vanderheiden |
| 4,824,654 | A | 4/1989 | Ota et al. |
| 5,120,365 | A | 6/1992 | Kogler |
| 5,164,172 | A | 11/1992 | Katayama et al. |
| 5,269,818 | A | 12/1993 | Kunesh et al. |
| 5,296,002 | A | 3/1994 | Passaretti |
| 5,320,897 | A | 6/1994 | Kondo et al. |
| 5,332,564 | A | 7/1994 | Chapnerkar et al. |
| 5,418,057 | A | 5/1995 | Kokiyoshi et al. |
| 5,454,864 | A | 10/1995 | Whalen-Shaw |
| 5,478,388 | A | 12/1995 | Gane et al. |
| 5,676,746 | A | 10/1997 | Brown |
| 5,731,034 | A | 3/1998 | Husband |
| 5,846,382 | A | 12/1998 | Von Raven |
| 5,861,209 | A | 1/1999 | Haskins et al. |
| 5,879,442 | A | 3/1999 | Nishiguchi et al. |
| 5,882,396 | A | 3/1999 | Hiorns |
| 5,939,036 | A | 8/1999 | Porter et al. |
| 6,071,336 | A | 6/2000 | Fairchild et al. |
| 6,150,289 | A | 11/2000 | Chen et al. |
| 6,156,286 | A | 12/2000 | Fortier et al. |
| 6,207,258 | B1 | 3/2001 | Varnell |
| 6,221,146 | B1 | 4/2001 | Fortier et al. |
| 6,380,265 | B1 | 4/2002 | Pryor et al. |
| 6,402,824 | B1 | 6/2002 | Freeman et al. |
| 6,554,410 | B2 | 4/2003 | Jeanmaire et al. |
| 6,630,229 | B1 | 10/2003 | Normington et al. |
| RE38,301 | E | 11/2003 | Bleakley et al. |
| 6,677,386 | B1 | 1/2004 | Giezen et al. |
| 6,685,908 | B1 | 2/2004 | Yaniv |
| 6,698,880 | B1 | 3/2004 | Campbell et al. |
| 6,780,920 | B2 | 8/2004 | Chapman et al. |
| 6,825,252 | B2 | 11/2004 | Helbling et al. |
| 6,841,609 | B2 | 1/2005 | Chapman et al. |
| 6,863,775 | B2 | 3/2005 | Bobsein et al. |

(Continued)

FOREIGN PATENT DOCUMENTS

| | | |
|---|---|---|
| EP | 1114735 | 7/2001 |
| EP | 2196320 | 6/2010 |

(Continued)

OTHER PUBLICATIONS

PCT, International Search Report and Written Opinion, International Application No. PCT/US2013/035759 (Jul. 26, 2013).

Dimmick, A.C., "Effects of Sheet Moisture and Calender Pressure on PCC and GCC Coated Papers," TAPPI Journal (Nov. 2007).

Hugener, P. et al., "A New Coating Ground Calcium Carbonate for Enhanced Paper Properties" (Apr. 26, 2010).

Lee, D.I. et al., "Development of New Biobased Emulsion Binders," presented at TAPPI PaperCon 2010, Talent, Technology and Transformation, Atlanta, GA (May 2-5, 2010).

Press Release, Kodak Focuses on Delivering Offset Class Quality, Providing Scaleable Solutions with Inkjet Printing Systems (Jan. 17, 2008).

(Continued)

*Primary Examiner* — Betelhem Shewareged

(74) *Attorney, Agent, or Firm* — Thompson Hine L.L.P.

(57) ABSTRACT

An inkjet recording medium and a coating composition for forming an inkjet recording medium. In accordance with one aspect of the present invention, an inkjet recording medium is disclosed comprising an inkjet-receptive coating on a paper substrate. The inkjet-receptive coating contains a synergistic combination of pigments, binder and a multivalent metal salt such that the inkjet recording medium exhibits improved inkjet print properties, particularly when printed with a high speed inkjet printer using pigmented inks

12 Claims, No Drawings

(56) References Cited

U.S. PATENT DOCUMENTS

| | | | | |
|---|---|---|---|---|
| 6,921,430 | B2 | 7/2005 | Bloembergen et al. | |
| 7,014,893 | B2 | 3/2006 | Wicher et al. | |
| 7,285,586 | B2 | 10/2007 | Helbling et al. | |
| 7,351,278 | B2 | 4/2008 | Jackson | |
| 7,393,571 | B2 | 7/2008 | Chapman et al. | |
| 7,452,592 | B2 | 11/2008 | Cowton | |
| 7,553,395 | B2 | 6/2009 | Stoffel et al. | |
| 7,615,265 | B2 | 11/2009 | Stork et al. | |
| 7,803,224 | B2 | 9/2010 | Schliesman et al. | |
| 8,092,873 | B2 | 1/2012 | Wang et al. | |
| 8,256,887 | B2 | 9/2012 | Zhou et al. | |
| 8,425,728 | B2 | 4/2013 | Zhou et al. | |
| 8,480,225 | B2 | 7/2013 | Romano, Jr. et al. | |
| 8,562,126 | B1 | 10/2013 | Xiang et al. | |
| 2003/0064208 | A1 | 4/2003 | Yamada et al. | |
| 2003/0099816 | A1 | 5/2003 | Liu et al. | |
| 2003/0180478 | A1 | 9/2003 | Fruge et al. | |
| 2003/0191226 | A1 | 10/2003 | Chapman et al. | |
| 2003/0203133 | A1 | 10/2003 | Maekawa | |
| 2004/0080595 | A1* | 4/2004 | Taguchi et al. | 347/100 |
| 2004/0189778 | A1 | 9/2004 | Stork et al. | |
| 2004/0255820 | A1 | 12/2004 | Chen et al. | |
| 2005/0003113 | A1 | 1/2005 | Chen et al. | |
| 2006/0054291 | A1 | 3/2006 | Dimmick et al. | |
| 2006/0060317 | A1 | 3/2006 | Roding et al. | |
| 2006/0061641 | A1 | 3/2006 | Ueki et al. | |
| 2006/0098066 | A1 | 5/2006 | Bauer | |
| 2006/0099408 | A1 | 5/2006 | Andersson et al. | |
| 2006/0102304 | A1 | 5/2006 | Nutbeem et al. | |
| 2006/0112855 | A1 | 6/2006 | Andersson et al. | |
| 2006/0137574 | A1* | 6/2006 | Preston et al. | 106/464 |
| 2006/0139406 | A1 | 6/2006 | Tsuchiya et al. | |
| 2006/0159910 | A1 | 7/2006 | Song et al. | |
| 2006/0272549 | A1 | 12/2006 | Mathur et al. | |
| 2006/0292305 | A1 | 12/2006 | Skuse et al. | |
| 2007/0237909 | A1 | 10/2007 | McManus | |
| 2008/0008846 | A1 | 1/2008 | Zhou et al. | |
| 2008/0032074 | A1 | 2/2008 | Doi et al. | |
| 2008/0268185 | A1 | 10/2008 | Chen et al. | |
| 2009/0035478 | A1 | 2/2009 | Zhou et al. | |
| 2009/0074995 | A1 | 3/2009 | Dannhauser et al. | |
| 2009/0087568 | A1 | 4/2009 | Kobayashi | |
| 2009/0123675 | A1 | 5/2009 | Shaw-Klein et al. | |
| 2009/0131570 | A1 | 5/2009 | Schliesman et al. | |
| 2009/0169455 | A1 | 7/2009 | Van Aert et al. | |
| 2009/0203643 | A1 | 8/2009 | Patel | |
| 2010/0159164 | A1 | 6/2010 | Zhang et al. | |
| 2011/0012970 | A1 | 1/2011 | Zhou et al. | |
| 2011/0037818 | A1 | 2/2011 | Romano, Jr. et al. | |
| 2011/0050827 | A1 | 3/2011 | Romano, Jr. et al. | |
| 2011/0052818 | A1 | 3/2011 | Osterberg et al. | |
| 2011/0069106 | A1 | 3/2011 | Song et al. | |
| 2011/0104406 | A1 | 5/2011 | Zhou et al. | |
| 2011/0244148 | A1 | 10/2011 | Zhou et al. | |
| 2011/0279554 | A1 | 11/2011 | Dannhauser et al. | |
| 2012/0012264 | A1 | 1/2012 | Zhou et al. | |
| 2012/0034398 | A1 | 2/2012 | Wang et al. | |
| 2012/0038701 | A1 | 2/2012 | Schalkhammer et al. | |
| 2012/0114880 | A1 | 5/2012 | Nagoshi et al. | |
| 2012/0154502 | A1 | 6/2012 | Romano, Jr. et al. | |
| 2012/0212555 | A1 | 8/2012 | Romano, Jr. | |

FOREIGN PATENT DOCUMENTS

| | | |
|---|---|---|
| EP | 2692537 | 2/2014 |
| JP | 55-51583 | 4/1980 |
| JP | 2011-025504 | 2/2011 |
| JP | 2013-193212 | 9/2013 |
| WO | 03/031191 | 4/2003 |
| WO | 03/031191 A2 | 4/2003 |
| WO | 03/031191 A3 | 4/2003 |
| WO | 2004/005039 | 1/2004 |
| WO | 2004/061014 | 7/2004 |
| WO | 2006/116878 | 11/2006 |
| WO | 2007/112013 | 10/2007 |
| WO | 2009/095697 | 8/2009 |
| WO | 2009/110910 | 9/2009 |
| WO | 2010/065750 | 6/2010 |
| WO | 2010/114560 | 10/2010 |
| WO | 2011/019866 | 2/2011 |
| WO | 2011/026070 | 3/2011 |
| WO | 2012/083015 | 6/2012 |
| WO | 2012203595 | 1/2013 |
| WO | 2012/057790 | 5/2013 |
| WO | 2013/095373 | 6/2013 |
| WO | 2013/165882 | 11/2013 |

OTHER PUBLICATIONS

Product Information, "HYDRAFINE® Kaolin Clay," KaMin Performance Minerals (2009).

Product Information, "HYDRAGLOSS® 90 Kaolin Clay," KaMin Performance Minerals (2009).

Product Information, "SYLOJET® C30 Cationic Porous Silica Dispersion for Ink Jet and Other Functional Coatings," W.R. Grace & Co. (Mar. 26, 2009).

Svanholm, "An Experimental Study of Inkjet Receptive Coatings" (Nov. 15, 2004).

Svanholm, Eric., "Printability and Ink-Coating Interactions in Inkjet Printing", Faculty of Technology and Science Chemical Engineering, Dissertation, Karlstad University Studies, 2007:2.

Wilson, I., "Filler and Coating Pigments and Papermakers," Industrial Minerals & Rocks: Commodities, Markets, and Uses, 7th Edition, pp. 1287-1300 (2006).

"Formulation Guide for ECOSPHERE® Biolatex Binders," by EcoSynthetix Inc. (2010).

"Technical Data Sheet. ECOSPHERE® 2240 biolatex® binder for coated paper and paperboard," by EcoSynthetix Inc. (2010).

"Handling Options for EcoSphere® Biolatex® Binders," by EcoSynthetix (date of first publication unknown).

* cited by examiner

RECORDING MEDIUM FOR INKJET PRINTING

CROSS REFERENCE TO RELATED APPLICATIONS

This application is a continuation in part of U.S. application Ser. No. 13/859,239, filed on Apr. 9, 2013, which claims the benefit of U.S. Provisional Application Ser. No. 61/682,416, filed on Aug. 13, 2012 and U.S. Provisional Application No. 61/623,931, filed on Apr. 13, 2012, the entire contents of which are hereby incorporated by reference.

BACKGROUND

The present application relates to an inkjet recording medium and a coating composition for forming an inkjet recording medium. More specifically, the inkjet coating composition disclosed herein contains a multivalent salt and the resulting recording medium is particularly useful for high speed multi-color printing such as high speed inkjet printing.

Traditionally, commercial printing presses print catalogs, brochures and direct mail using offset printing. However, advances in inkjet technology have led to increased penetration into commercial print shops. Inkjet technology provides a high-quality alternative to offset printing for improving response rates, reducing cost, and increasing demand for products. In addition to printing high quality variable images and text, these printers incorporate a roll-fed paper transport system that enables fast, high-volume printing. Inkjet technology may be now being used for on-demand production of local magazines, newspapers, small-lot printing, textbooks, and transactional printing worldwide.

Web fed inkjet systems are being developed that enable offset class quality, productivity, reliability and cost with the full benefits of digital printing for high volume commercial applications. These systems allow continuous inkjet printing to expand beyond the core base of transactional printers and secondary imprinting and into high volume commercial applications.

In accordance with certain aspects of the present invention, a recording medium may be described which provides fast drying times, and excellent image quality when printed using high speed inkjet devices used in commercial printing applications.

SUMMARY

The present application describes an inkjet recording medium and a coating composition for forming an inkjet recording medium. In accordance with one aspect of the present invention, an inkjet recording medium may be disclosed comprising an inkjet-receptive coating on a paper substrate. The inkjet-receptive coating contains a synergistic combination of pigments, binder and a multivalent salt such that the inkjet recording medium exhibits improved inkjet print properties, particularly when printed with a high speed inkjet printer using pigmented or dye based inks In accordance with certain embodiments, the paper coating includes fine and/or medium ground calcium carbonate, a binder and, optionally, a co-binder. Typically, a multi-valent salt may be also included in the coating composition. More specifically, the coating may contain a primary pigment comprising a ground calcium carbonate having a median particle size (D50) of about 0.5-1.6 microns, a multivalent salt, a dispersant and a binder. The binder may be typically present in an amount from about 2 to 15 parts by weight of based on 100 parts total pigments.

In accordance with particular embodiments, the primary pigment may be a mixture of two or more different calcium carbonate median particle sizes, or particle size distributions. The primary pigment may comprise a first calcium carbonate having a first median particle size and a second calcium carbonate having a second median particle size different than said first median particle size.

The coating and coated paper of the instant invention may be particularly useful with both dye and pigmented ink jet inks

DETAILED DESCRIPTION

The coating for producing the inkjet recording medium typically includes one or more fine ground, medium ground, or coarse ground calcium carbonates. Further, the coating typically includes a binder and, optionally, a co-binder. Pigments typically comprise the largest portion of the coating composition on a dry weight basis. Unless otherwise noted, amounts of component materials may be expressed in terms of component parts per 100 parts of total pigment on a weight basis.

The coating composition contains a primary pigment, typically calcium carbonate. Calcium carbonate may be useful as the primary pigment in any form, including aragonite, calcite or mixtures thereof. Fine and/or medium ground carbonates may be particularly useful as a primary pigment. Fine and/or medium ground calcium carbonate, when present as the primary pigment, typically makes up 50 to 100 parts of the coating pigment on a dry weight basis. In certain embodiments, the calcium carbonate may be from about 75 to 100 parts of the pigment weight. A particularly useful pigment may be a medium ground carbonate such as OMYA Hydrocarb® 60 ground calcium carbonate (OMYA AG, Oftringen, Switzerland). It provides the porous structure for successful ink absorption but less paper gloss development. This pigment may be considered a medium ground calcium carbonate and, in accordance with certain embodiments, has a particle size distribution where about 55-65%, more particularly about 58-62% and in some cases about 60% of the particles have a diameter less than about 2 microns, about 30-35%, more particularly about 31-33% and in some cases about 32% have a diameter less than about 1 micron and about 5-10%, more particularly about 6-8% and in some cases about 7% have a diameter less than about 0.2 microns. The median particle size (D50) may be about 1.0-1.8 microns, more particularly about 1.2-1.6 microns and in some cases about 1.4 microns.

The primary pigment may comprise a mixture of different particle size calcium carbonate pigments. For example, other pigments considered fine calcium carbonates can also be used in the coatings. In accordance with one embodiment, the fine ground calcium carbonates used in the coating may have a narrow particle size distribution where about 85-95%, more particularly about 90% of the particles may be less than about 2 microns in diameter, at least about 60-70%, more particularly about 65% by weight of the particles may be less than about 1 micron and the pigments have a mean particle size of about 0.5-1 microns, more particularly about 0.6-0.8 microns and still more particularly about 0.7 microns. In accordance with certain embodiments, the fine ground calcium carbonate in accordance with this paragraph may be from about 0 to about 50 parts, more particularly from about 10 to about 40 parts, of the total pigment by weight. A particularly useful pigment may be a fine ground carbonate such as OMYA Hydrocarb® 90 ground calcium carbonate (OMYA AG, Oftringen, Switzerland).

Coarse ground calcium carbonates may also be used in the coating. In accordance with certain embodiments, these pigments have a narrow particle size distribution where about 38% of the particles may be less than 2 microns in diameter. Preferably, at least 15-25%, more particularly about 18-22%, still more particularly about 20% by weight of the particles may be less than 1 micron and have a mean particle size of about 3.0-3.5 microns, more particularly about 3.1-3.3 microns, and still more particularly about 3.20 microns. In another embodiment, the distribution has at least 85% of the particles less than about 1 micron and fall in the range of 0.1-1 microns. In accordance with certain embodiments, the coarse ground calcium carbonate may be from about 0 to about 20 parts, more particularly from about 10 to about 15 parts, of the total pigment by weight. A particularly useful pigment may be a coarse ground carbonate such as Hydrocarb® PG-3 ground calcite calcium carbonate (OMYA AG, Oftringen, Switzerland).

One or more secondary pigments may also be added. Examples of secondary pigments include anionic pigments, cationic pigments, plastic pigments, carbonates, clays, silicates, silicas, titanium dioxide, aluminum oxides and aluminum trihydrates. Secondary pigments, when present, may be present in amounts from about 1-50 parts, more particularly from about 8-16 parts.

Cationic pigments may be examples of secondary pigments that may be added to the coating. When fully assembled, the coating typically may have an overall anionic nature. Attractive forces between the anionic coating and cationic pigment may open up surface pores in the coating, increasing porosity and an ink absorption rate. Ink drying times may be also reduced. Additionally, since the ionic interaction may be on a very small scale, the improved porosity may be uniform over the coating surface. The particle size distribution of the cationic pigment typically has an average particle size less than 3.0 microns and typically may be grit-free. The term "grit-free" is intended to mean there are substantially no particles on a 325 mesh screen after passing the cationic pigment through the 325 mesh screen. In some embodiments, substantially all of the particles in the secondary pigment may be sized at less than 1 micron. Amounts of the cationic pigment may be typically less than 20 parts based on 100 parts by weight of the total pigment. Use of excessive cationic component may lead to undesirable ionic interaction and chemical reactions that can change the nature of the coating. The cationic pigment may be present in amounts greater than 5 parts cationic pigment per 100 total parts pigment. Particularly useful cationic pigments include cationic OMYAJET B 6606, OMYAJET C 3301, and 5010 pigments (OMYA AG, Oftringen, Switzerland). The OMYAJET pigments may be cationic aqueous slurries of high surface area modified calcium carbonate. The mean particle size (D50) ranges from about 1.3 microns to about 2 microns. The surface area BET ranges from about 40 $mg/m^2$ to about 56 $mg/m^2$. About 50-80% of the particles may be less than 2 microns.

Secondary pigments such as anionic pigments may be used in the formulation as needed to improve gloss, whiteness or other coating properties. Up to an additional 30 parts by weight of the dry coating pigment may be an anionic pigment. Up to 25 parts, more particularly less than 20 parts, of the pigment may be a coarse ground calcium carbonate, another carbonate, plastic pigment, $TiO_2$, or mixtures thereof. An example of a coarse ground calcium carbonate is Carbital 35 calcium carbonate (Imerys, Roswell, Ga.). (Mean particle size (D50)=about 2.7-3.2, more particularly about 2.9 microns, with about 35-40, more particularly about 37% of the particles less than 2 microns, about 15-20%, more particularly about 18% less than 1 micron, about 5-10%, more particularly about 8% less than 0.5 microns, and about 2-5%, more particularly about 3% less than 0.25 microns. Typical surface area for coarse ground carbonate may be about 3.4-3.8, more particularly about 3.6 $mg/m^2$.) Another pigment that may be used is anionic titanium dioxide, such as that available from Itochu Chemicals America (White Plains, N.Y.). Hollow spheres may be particularly useful plastic pigments for paper glossing. Examples of hollow sphere pigments include ROPAQUE AF-1353 and ROPAQUE AF-1055 (Rohm & Haas, Philadelphia, Pa.). Higher gloss papers may be obtainable when fine pigments may be used that have a small particle size. The relative amounts of these pigments may be varied depending on the whiteness and desired gloss levels.

A primary binder may be added to the coating for adhesion. In accordance with certain embodiments, the binder may be compatible with the incorporation of a multivalent salt. In accordance with certain aspects, the binder may be one that has been rendered stable to formulations or coatings containing multi-valent salts. The binder may be a non-ionic synthetic latex or it may be an anionic synthetic latex, such as styrene-butadiene, that has been rendered stable to formulations or coatings containing multi-valent salts. These binders that would otherwise be incompatible with the presence of multi-valent salts may be modified to render them compatible through various modifications such as through the use of particular surfactants. Particularly useful binders include calcium stable styrene butadiene rubber (SBR) lattices. Acrylic polymers, polyurethanes, or ethylene vinyl acetate polymers may also be used. The binder may also be a biopolymer such as a starch or protein.

In accordance with particularly useful embodiments, the polymer may comprise biopolymer particles, more particularly biopolymer microparticles and in accordance with certain embodiments, biopolymer nanoparticles. In accordance with particularly useful aspects, the biopolymer particles comprise starch particles and, more particularly, starch nanoparticles having an average particle size of less than 400 nm. Compositions containing a biopolymer latex conjugate comprising a biopolymer-additive complex reacted with a crosslinking agent as described in WO 2010/065750 may be particularly useful. Biopolymer-based binders and, in particular, those binders containing biopolymer particles have been found to be compatible with the inclusion of a multivalent salt in the coating formulation and facilitate coating production and processing. For example, in some cases coating compositions can be prepared at high solids while maintaining acceptable viscosity for the coating composition. Binders that may find use in the present application are disclosed in U.S. Pat. Nos. 6,677,386; 6,825,252; 6,921,430; 7,285,586; and 7,452,592, and WO 2010/065750, the relevant disclosure in each of these documents is hereby incorporated by reference. One example of a suitable binder containing biopolymer nanoparticles is Ecosphere® 2240 available from Ecosynthetix Inc.

The binder may also be a synthetic solution polymer such as polyvinyl alcohol, polyvinyl pyrrolidone, polyethylene oxide, etc.

The total amount of primary binder typically may be from about 2 to about 15, more particularly about 5 to about 12, parts per 100 parts of total pigments.

The coating may also include a co-binder that may be used in addition to the primary binder. Examples of useful co-binders include polyvinyl alcohol, polyvinyl acetate, and protein binders. Another co-binder that may be useful in some embodiments may be starch, including enzyme converted starches. Both cationic and anionic starches may be used as a co-binder. ADM Clineo 716 starch is an ethylated cornstarch (Archer Daniels Midland, Clinton, Iowa) that can be used. Penford® PG 260 and PG 290 may be examples of other ethylated starch co-binders that can be used. The binder levels should be carefully controlled. If too little binder is used, the coating structure may lack physical integrity, while if too much binder is used, the coating may become less porous resulting in longer ink drying times. The co-binder, when present, typically may be used in amounts of about 1 to about 8 parts co-binder per 100 parts of pigment on a dry weight basis, more particularly from about 2 to 6 parts co-binder per 100 parts dry pigment or from about 2 to 5 parts co-binder per 100 parts dry pigment.

The coating composition also includes a multivalent salt. In certain embodiments of the invention, the multivalent metal may be a divalent or trivalent cation. More particularly, the multivalent metal salt may be a cation selected from $Mg^{+2}$, $Ca^{+2}$, $Ba^{+2}$, $Zn^{+2}$, and $Al^{+2}$, in combination with suitable counter ions. Divalent cations such as $Ca^{+2}$ and $Mg^{+2}$ may be particularly useful. Combinations of cations may also be used.

Specific examples of the salt used in the coating include (but not limited to) calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Similar salts will be appreciated by the skilled artisan. Particularly useful salts include $CaCl_2$, $MgCl_2$, $MgSO_4$, $Ca(NO_3)_2$, and $Mg(NO_3)_2$, including hydrated versions of these salts. Combinations of the salts may also be used. The salt may be present in the coating in an amount of about 2.5 to 25 parts, more particularly about 4 to 12.5 parts by weight based per 100 total parts of pigment.

A dispersant may be used to facilitate processing of coating compositions containing higher coating solids. Particularly useful dispersants include Topsperse JXA (Polyether polycarboxylate, sodium salt in aqueous solution), Rheocarb 100 (Acrylic copolymer in aqueous solution), polyoxyalkylene sodium salt (Carbosperse™ K-XP228 polymer), and XP-1722 (Polyether polycarboxylate, sodium salt in aqueous solution) from Coatex, BYK-190 (Solution of a high molecular weight block copolymer with pigment affinic groups) and BYK-2010 (Acrylate copolymer with pigment affinic groups) from BYK Chemie, and Polystep TD-507 (Tridecyl alcohol ethoxylate) from Stepan Chemicals. In accordance with certain embodiments, the dispersant may be present in an amount of about 0.5 to 2.5 part, more particularly about 0.75 to 2 parts per 100 parts of total pigments.

A water retention aid may also be included in the coating to improve water retention. Coatings containing multivalent ions can lack sufficient water holding capability for commercial applications. One such retention aid may be Natrasol GR (Aqualon). In addition to increasing water retention, a secondary advantage may be that it enhances the binding strength of the biopolymer. This has previously not been observed. Tape pulls indicate better strength. Examples of water retention aids for use herein include, but may not be limited to, polyethylene oxide, hydroxyethyl cellulose, polyvinyl alcohol, starches, and other commercially available products sold for such applications. In accordance with certain embodiments, the water retention aid may be present in an amount of about 0.1 to 1 part, more particularly about 0.2 to 0.5 parts per 100 parts of total pigments.

Other optional additives may be used to vary properties of the coating. Brightening agents, such as Clariant T26 Optical Brightening Agent, (Clariant Corporation, McHenry, Ill.) can be used. Insolubilizers or cross-linkers may be useful. Examples of particularly useful cross-linkers include Sequarez 755 (RohmNova, Akron, Ohio) and glyoxal (BASF). A lubricant may be optionally added to reduce drag when the coating may be applied with a blade coater. These optional additives, when present, may be typically present in an amount of about 0.1 to 5 parts, more particularly about 0.2 to 2 parts per 100 parts of total pigments.

Conventional mixing techniques may be used in making this coating. If starch is used, it typically may be cooked prior to preparing the coating using a starch cooker. In accordance with certain embodiments, the starch may be made down to approximately 35% solids. Separately, all of the pigments, including the primary pigment, secondary and any supplemental pigments, may be mixed for several minutes to ensure no settling has occurred. In the laboratory, the pigments may be mixed on a drill press mixer using a paddle mixer. The primary binder may be then added to the mixer, followed by the co-binder 1-2 minutes later. If starch is used, it may be typically added to the mixer while it may be still warm from the cooker, approximately 190° F. The final coating may be made by dispersion of the mixed components in water. Solids content of the dispersion typically may be from about 20% to about 60% by weight. More particularly, the solids may be about 45% to about 55% of the dispersion by weight.

Yet another embodiment relates to an improved printing paper having a paper substrate to which the coating has been applied on at least one surface. Any coating method or apparatus may be used, including, but not limited to, roll coaters, jet coaters, blade coaters or rod coaters. The coating weight may be typically about 2 to about 10, more particularly about 5 to about 8 pounds (dry weight) per 3300 $ft.^2$ per side, to size press, pre-coated or unsized base papers. Coated papers would typically range from about 30 lb. to about 250 lb./3300 $ft.^2$ of paper surface. The coated paper may be then optionally finished using conventional methods to the desired caliper or gloss.

The substrate or base sheet may be a conventional base sheet. Examples of useful base sheets include 45 lb., Pub Matte, and NewPage 45 lb. New Era, both from the Escanaba Paper Company, a subsidiary of NewPage Corporation Escanaba, Mich. mill.

The finished coated paper may be useful for printing Ink may be applied to the coating to create an image. After application, the ink vehicle penetrates the coating and may be absorbed therein. The number and uniformity of the coating pores result in even and rapid ink absorption, even when multiple layers of ink are applied. This coated paper may also be well suited for multifunctional printing, whereby an image on a coated paper media may be created from combinations of dyes or pigmented inks from ink jet printers, toner from laser printers and inks from gravure or flexo presses.

In one embodiment the formulations below may be coated on NewEra base paper manufactured at the NewPage, Escanaba mill by means of a blade coater at 5-10 lbs per side (per 3,300 $ft.^2$). The base paper typically contains a mixture of softwood and hardwood fibers. Softwood fibers typically are present in an amount of about 45-55% hardwood fibers are present in an amount of about 4-10%, RMP fibers in an amount of about 20-30% and broke may be present in the amount of about 20%. In accordance with a particularly useful base paper, the softwood and hardwood fibers are present in a ratio of 8:1, respectively.

The following non-limiting examples illustrate specific aspects of the present invention.

The coating formulations are reported based upon a total of 100 parts pigment. Non-pigment ingredients are reported in terms of parts per 100 parts pigment. The ink jet receptive coatings were calendered at 1200 PLI/100° F. using 3 nips/side. A test target was printed on the resulting paper with a Kodak patch printer containing standard Kodak Prosper pigmented inks A cyan step wedge was measured for grain and mottle using a Personal Image Analysis System (PIAS) manufactured by QEA. Mottle is a density non-uniformity that occurs at a low spatial frequency (i.e., noise at a coarse scale). Grain is a density non-uniformity that occurs at high spatial frequencies (i.e. noise at a fine scale). A lower number indicates less grain and mottle. A black Dmax patch was used to measure black density and wet abrasion. For wet abrasion, a round 100 g weight was used, with no additional pressure applied. The optical density may be measured in three areas on the black patch and the average may be recorded. Three (3) drops of water are dropped on the patch and allowed to stand for about 20 seconds. Two (2) pieces of Scott C-fold towels are placed on top of the patch and rubbed with the weight on top for five (5) cycles. The optical densities are re-measured inside and outside of the drop, taking the average of three (3) readings and the percent change in density may be reported.

Comparative samples were also printed using Kodak Prosper pigment based inks and evaluated in the same manner as the test samples. Comparative Example 1 and Comparative Example 2 are NewPage 45 lb. NewEra and NewPage 45# Publication Matte. Both are commercial coated papers coated on both sides with coatings containing clay, calcium carbonate and a latex binder. The coat weight on each side typically may be about 7-8 lbs./ream on a 30 lb. base sheet for a coated sheet with a nominal weight of 45 lb. The results in Table 1 show that the inventive examples exhibit improved mottle compared to the comparative examples.

TABLE 1A

Non-limiting Coating Formulation Examples

| Coating Formulation | Invention Example 1 | Invention Example 2 | Invention Example 3 | Invention Example 4 | Invention Example 5 | Invention Example 6 | Invention Example 7 | Invention Example 8 |
|---|---|---|---|---|---|---|---|---|
| Hydrocarb 60 | 100 | 90 | 87.7 | 75 | 60 | 45 | 30 | 15 |
| Hydrocarb 90 | | 10 | | 25 | 40 | 55 | 70 | 85 |
| Carbital 35 | | | 12.3 | | | | | |
| XL-2800 | 7 | 7 | 7 | 7 | 7 | 7 | 7 | 7 |
| Penford ® Gum 290 Starch | 4 | 4 | 4 | 4 | 4 | 4 | 4 | 4 |
| Topsperse JXA | 1 | 1 | 1 | 1 | 1 | 1 | 1 | 1 |
| 40% Glyoxal | 0.33 | 0.33 | 0.33 | 0.33 | 0.33 | 0.33 | 0.33 | 0.33 |
| Calcium chloride | 5 | 5 | 5 | 5 | 5 | 5 | 5 | 5 |
| Berchem 4136 | 0.65 | 0.65 | 0.65 | 0.65 | 0.65 | 0.65 | 0.65 | 0.65 |
| Max Cyan Density | 1.298 | 1.312 | 1.298 | 1.315 | 1.321 | 1.336 | 1.35 | 1.368 |
| Max L (CIE) Grain | 2.74 | 2.67 | 2.57 | 2.88 | 2.93 | 2.97 | 3.13 | 3.21 |
| Sum L (CIE) Grain | 21.62 | 21.01 | 20.90 | 22.43 | 22.78 | 22.99 | 23.36 | 24.07 |
| Max L (CIE) Mottle | 0.89 | 0.83 | 0.84 | 0.84 | 0.84 | 0.93 | 1.04 | 1.06 |
| Sum L (CIE) Mottle | 7.97 | 7.67 | 7.80 | 7.16 | 7.66 | 7.67 | 8.15 | 8.54 |
| Max Black Density | 1.26 | 1.27 | 1.25 | 1.31 | 1.33 | 1.34 | 1.39 | 1.40 |
| Wet Abrasion in drop | 28% | 22% | 23% | 23% | 35% | 39% | 44% | 33% |
| Wet Abrasion out drop | 15% | 13% | 15% | 12% | 20% | 21% | 19% | 22% |

TABLE 1B

Comparative Coating Formulation Examples

| Coating Formulation | Comparative Example 1 45 lb New Page New Era | Comparative Example 2 45 lb New Page Pub Matte |
|---|---|---|
| Max Cyan Density | 1.225 | 1.076 |
| Max L (CIE) Grain | 2.32 | 1.76 |
| Sum L (CIE) Grain | 20.17 | 16.46 |
| Max L (CIE) Mottle | 1.52 | 1.28 |
| Sum L (CIE) Mottle | 9.67 | 7.88 |
| Max Black Density | 1.38 | 1.15 |
| Wet Abrasion in drop | 31% | 32% |
| Wet Abrasion out drop | 25% | 18% |

TABLE 1C

| Examples with and without dispersant | | | | | | |
|---|---|---|---|---|---|---|
| | Dry Parts | Dry Parts | Dry Parts | Dry Parts | Dry Parts | Dry Parts |
| Hydrocarb 60 | 87.7 | 87.7 | 87.7 | 87.7 | 87.7 | 87.7 |
| CGC | 12.3 | 12.3 | 12.3 | 12.3 | 12.3 | 12.3 |
| PG290 | 4 | 4 | 4 | 4 | 4 | 4 |
| XL-2800 | 7 | 7 | 7 | 7 | 7 | 7 |
| Topsperse JXA | | 1 | | | | |
| XP 1722 | | | | | | |
| Rheocarb 100 | | | 1 | | | |
| BYK-190 | | | | 1 | | |
| BYK-2010 | | | | | 1 | |
| Polystep TD-507 | | | | | | |
| Seqaurez 755 | 1 | 1 | 1 | 1 | 1 | 1 |
| CaCl2 | 5 | 5 | 5 | 5 | 5 | 5 |
| Berchem 4136 | 0.65 | 0.65 | 0.65 | 0.65 | 0.65 | 0.65 |
| Brookfield Viscosity (cps) @50 rpm, 90° F. | 2920 | 1190 | 1400 | 1650 | 1090 | 2000 |

TABLE 1D

| Invention Example with XP228 dispersant | |
|---|---|
| Coating Formulation | Dry Parts |
| Covercarb HP | |
| CGC | |

TABLE 1D-continued

| Invention Example with XP228 dispersant | |
|---|---|
| Coating Formulation | Dry Parts |
| AF-1353 | |
| Hydrocarb 60 | 95.5 |
| RPS Vantage TiO2 | 4.5 |
| PG290 | 5 |
| XL2800 | 7 |
| Carbosperse K XP228 | 1 |
| Glyocal | 0.25 |
| PG260 | |
| CaCl2 | 5 |

TABLE 1D-continued

| Invention Example with XP228 dispersant | |
|---|---|
| Coating Formulation | Dry Parts |
| Berchem 4113 | |
| % Solids | 64.9 |
| pH | 5.16 |
| Brookfield Visc. @ 90° F./20 RPM | 1550 |
| Spindle | 4 |

TABLE 1E

| Example without glossing pigment (dry) | |
|---|---|
| Pigments | |
| Hydrocarb 60 | 57.1 |
| TiPure RPS Vantage | 6.7 |
| Hydrocarb 90 | 36.2 |
| Binders | |
| Omnova - XL 4800 Calcium Stable Latex (47% solids) | 7 |
| Clinton 130 Starch | 5 |
| Additives | |
| Curesan 400 (40% glyoxal) - run 5% glyoxal based on dry starch | 0.25 |
| Coatex XP 1838 - dispersant - run 1% dry dipersant based on dry pigment | 1.75 |
| Sicalco, Liquidow Calcium | 5 |

TABLE 2

| Non-limiting Coating Formulation Ranges | | | |
|---|---|---|---|
| Generic Material | Broad Range Dry Parts | Narrow Range Dry Parts | Example Material |
| Primary Pigment (Fine/Medium Ground Carbonate) | 50-100 | 65-100 | Hydrocarb 60 and Hydrocarb 90 (Omya) |
| Coarse Ground Calcium Carbonate | 0-40 | 0-15 | Hydrocarb PG-3 (Omya), Carbital 35 (Imerys) |
| Cationic Pigment | 0-15 | 0-10 | Omyajet 5010, KaoJet (Thiele) |
| Secondary Pigment | 0-10 | 2-8 | Titanium dioxide (TiPure RPS Vantage) |
| Primary Binder | 2-15 | 5-12 | XL-2800 Ca Stable Latex (OMNOVA) |
| Co-binder | 0-10 | 2-7.5 | Starch (Clinton 130 starch) |
| Multivalent Salt | 2.5-12 | 3-7 | Calcium Chloride (Sicalco Liquidow) |
| Glossing Pigment | 0-15 | 0-12.5 | Ropaque AF-1353 |
| Crosslinker | 0-1 | 0-0.7 | Glyoxal (Curescan 400) |
| Lubricant | 0-1 | 0-0.8 | Berchem 4136 |
| Water Retention aid | 0-2 | 0-1 | Hydroxyethyl cellulose |
| Dispersant | 0.2-2.5 | 0.5-2.0 | Coatex Topsperse JXA, XP 1838 |

While the compositions and methods described herein constitute preferred embodiments of the disclosed invention, it is to be understood that the invention is not limited to these precise compositions and methods, and that variations may be made therein without departing from the scope of the invention.

What is claimed is:

1. An inkjet recording medium comprising:

a paper substrate; and an inkjet-receptive coating comprising a primary pigment comprising a ground calcium carbonate having a median particle size (D50) of about 0.5-1.6 microns;

a multivalent salt;

a dispersant; and a binder wherein said binder is present in an amount from about 2 to 15 parts by weight of based on 100 parts total pigments; wherein said primary pigment comprises a first calcium carbonate having a first median particle size and a second calcium carbonate having a second median particle size different than said first median particle size.

2. The inkjet recording medium of claim 1 wherein the binder comprises a latex that has been rendered stable to formulations or coatings containing multi-valent salts.

3. The inkjet recording medium of claim 2 wherein the binder comprises a styrene butadiene rubber latex.

4. The inkjet recording medium of claim 1 wherein said coating further comprises a co-binder selected from the group consisting of protein binders, polyvinyl alcohol, polyvinyl acetate, starch and mixtures thereof.

5. The inkjet recording medium of claim 4 wherein the co-binder comprises starch.

6. The inkjet recording medium of claim 1 wherein said primary pigment is present in an amount of about 50 to 100 parts based on 100 parts total pigments.

7. The inkjet recording medium of claim 1 wherein said coating is present at a coat weight of about 5 to 10 lbs./ream dry weight (3,300 $ft.^2$) per side.

8. The inkjet recording medium of claim 1 wherein the multivalent metal salt is selected from the group consisting of calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, aluminum nitrate and mixtures thereof.

9. The inkjet recording medium of claim 8 wherein the multivalent metal salt comprises calcium chloride.

10. The ink jet recording medium of claim 1 wherein the dispersant is selected from the group consisiting of polyether polycarboxylate sodium salt, acrylic copolymer, polyether polycarboxylate sodium salt, polyoxyalkylene sodium salt, block copolymers with pigment affinic groups, acrylate copolymers with pigment affinic groups, tridecyl alcohol ethoxylate and mixtures thereof.

11. The ink jet recording medium of claim 1 wherein the dispersant comprises a polyether polycarboxylate salt.

12. The ink jet recording medium of claim 1 wherein the medium further comprises a plastic pigment for glossing.

* * * * *